US005978983A

United States Patent [19]

Queen et al.

[11] Patent Number: 5,978,983

[45] Date of Patent: Nov. 9, 1999

[54] PORTABLE SHOWERING CABINET

[76] Inventors: Carl J. Queen, *deceased, late of Riviera Beach, Fla.*; Donna Queen, Administratrix, 3111 Horseshoe Cir., West Palm Beach, Fla. 33417

[21] Appl. No.: 09/056,310

[22] Filed: Apr. 7, 1998

Related U.S. Application Data

[63] Continuation-in-part of application No. 08/839,513, Apr. 14, 1997, abandoned.

[51] Int. Cl.[6] ..... A47K 3/022; A47K 3/08; A47K 3/22

[52] U.S. Cl. ..... 4/556; 4/555; 4/560.1; 4/568; 4/570; 4/579; 4/604; 4/626; 4/677

[58] Field of Search ..... 4/604, 556, 555, 4/560.1, 579, 578.1, 568, 570, 626, 677; 297/256.16

[56] References Cited

U.S. PATENT DOCUMENTS

| | | | |
|---|---|---|---|
| D. 261,796 | 11/1981 | Queen | 4/604 X |
| 1,178,994 | 4/1916 | Crump . | |
| 3,562,821 | 2/1971 | Queen | 4/604 |
| 3,616,467 | 11/1971 | Drain | 4/604 |
| 4,118,810 | 10/1978 | Brickhouse et al. | 4/556 |
| 4,248,266 | 2/1981 | Queen | 137/564.5 |
| 4,446,586 | 5/1984 | Reed et al. | 4/556 X |
| 4,523,341 | 6/1985 | Queen | 4/555 |
| 4,546,506 | 10/1985 | Houle et al. | 4/555 |
| 4,680,817 | 7/1987 | Sloan et al. | 4/556 X |
| 4,796,312 | 1/1989 | Corlew | 4/555 |
| 5,361,428 | 11/1994 | Nanowsky et al. | 4/604 X |
| 5,517,704 | 5/1996 | Dagostino | 4/560.1 |

FOREIGN PATENT DOCUMENTS

| | | | |
|---|---|---|---|
| 1300987 | 12/1972 | United Kingdom | 4/604 |

*Primary Examiner*—Steven O. Douglas
*Assistant Examiner*—Kathleen J. Prunner
*Attorney, Agent, or Firm*—Malin, Haley, DiMaggio & Crosby, PA

[57] ABSTRACT

A portable showering cabinet for use by non-ambulatory, aged, or other persons unable to use conventional showering and hygienic home care facilities, particularly useful for a private home, hospitality industry, residential schools, general and specialized hospitals, rehabilitation centers, and bedside care in a nursing home. The showering cabinet system provides daily hygienic care for disabled, with or without minimal assistance from a caregiver, eliminating the need for a caregiver to help a disabled person enter a shower stall and eliminating the need for a caregiver to perform the showering of the individual. The portable cabinet includes a water supply system that attaches to existing hot and cold water supply cabinets and a manually movable cabinet that has casters, allowing it to be moved easily and quickly along a floor surface to a bedside, and an improved access auxiliary seat to insure safe entrance by the patient into and out of the enclosure from a seated position on the outside of the cabinet. In one embodiment, a door for user ingress and egress of the cabinet includes a wrap around member that securely and conveniently encloses the cabinet when the door is closed.

21 Claims, 6 Drawing Sheets

PORTABLE SHOWERING CABINET

CROSS-REFERENCE TO RELATED APPLICATIONS

This is a continuation-in-part of application Ser. No. 08/839,513, filed Apr. 14, 1997, now abandoned.

BACKGROUND OF THE INVENTION

1. Field of the Invention

This invention relates generally to a hygienic care system primarily for the non-ambulatory and disabled in the private sector (at home), while a guest at a hotel or residential student, to provide showering and shampooing. Specifically, the invention provides for a portable showering cabinet, adapted for private, personal care, with or without the services of an attendant, and which does not require permanent installation, but uses existing conventional water and draining hardware accessible in the home or other facility, and one which is designed so that the wheelchair user or non-ambulatory patient can safely enter and exit through a side entrance door directly from the wheelchair. The user may also have access from a front door.

2. Description of the Related Art

Bathing cabinets for treating patients in a hospital or other institution are known in the prior art. U.S. Pat. No. 3,562,821 issued Feb. 16, 1971 to Carl J. Queen describes a permanently mounted bathing cabinet that includes interior shower plumbing and a patient access front water shielding door to receive a patient.

Currently there is emphasis on caring for patients in the private home, as opposed to institutional care. Early discharges from the hospital that returns a patient home while requiring the services of a caregiver, the growing population of the aged, the majority of which remain in the home, are contributors to the vital need and demand for a method of providing daily hygienic care with a system designed for the disabled and non ambulatory, while reducing or eliminating potential injury to the patient and the attendant caregiver.

Using the present invention, portable, personalized showering can be obtained for the disabled, the convalescent, the aged, and others who cannot utilize conventional bathtubs and showers. The showering cabinet provides for total body showering, shampooing, perineal cleansing, and may be used for sitz bath treatments. The showering cabinet is completely mobile and does not require costly or elaborate custom plumbing or electrical installation. The showering cabinet also provides for maximum safety in an environment that can be hazardous because of the exposure to slipping and falling by both patient and caregiver into and out of a shower stall or bathtub. With the present invention, a patient can be transferred with safety and comfort, due to the horizontal, side-mounted transfer platform (auxiliary seat) provided and the ability of the shower seat in the housing to align with the auxiliary platform and the wheelchair, which remains in position.

The showering system, being portable, has casters that can be locked into place. The system can be used in numerous environments that include the private home, rehabilitation centers, general and specialized hospitals, adult day care centers, and the acute and critical care units of nursing homes. The 1990 ADA (Americans with Disabilities Act), Title III, states that all public accommodations must provide accessible service and equipment for the disabled. Therefore, hotels and residential schools must offer usable showering facilities for the disabled. The showering system is extremely economical because it is portable, does not require costly renovations for use, and is connected to water and draining hardware already within the home or facility. Should the condition of the patient require assistance in obtaining care, the caregiver stands at the side, always within immediate access to the patient. The patient is always at chair height. The system does not require the use of mechanical lifting and lowering devices. The water entering the cabinet is through a control valve which maintains a selected temperature and shuts down in the event of a variation in the selected temperature.

BRIEF SUMMARY OF THE INVENTION

A showering cabinet for non-ambulatory (or ambulatory) patients comprising a waterproof patient enclosure housing having a top opening and a movable front closure door that opens for receiving a patient and closes to prevent forward water spray; and an interior seat that can be moved to help the patient safely enter and leave the housing.

The showering action provided by the interior of the cabinet includes a plurality of water spray nozzles which can be divided between upper and lower sections which are angled in directions around the inside walls of the side and back walls of the interior housing of the cabinet to provide a cross spray effect where streams of water are at skew angles to each other, resulting in maximum water coverage to the patient. Each of the spray nozzles is connected to a water conduit or pipe that is mounted inside the housing hidden from view between the front and back panel. In one embodiment a series of upper nozzles mounted on the inside surface of the housing are connected by a single conduit and a plurality of lower nozzles are likewise connected by a different water conduit. Each spray nozzle conduit, upper or lower, is individually controlled by an on/off valve mounted on one side of the cabinet for access by either the caregiver or the patient.

The patient seat has a back and horizontal platform with a large elongated opening in the very bottom. Mounted under the seat is a tubular device with fixed spray nozzles which is connected to a flexible hose that allows for inlet water sprayed in an upward motion for cleansing of the perineal area and which can be adapted for sitz baths. A water flow control device to adjust the flow of water entering for the perineal cleansing is placed for the convenience of the seated user in a location that will not be accidentally disturbed once the flow has been selected. The showering cabinet also has mounted on the outside a shampoo nozzle connected to a flexible hose that carries water that allows the caregiver to manually provide a shampoo and rinse for the patient while the patient is seated in the housing. The perineal/sitz bath nozzle spray has its own on/off valve as does the hand-held shampooing unit.

Water for showering is supplied from conventional hot and cold water spouts which may be sink taps or a diverter valve and spout on a shower head or a bathtub spout. A pair of flexible plastic inlet hoses, one for hot water and one for cold water are connected individually to hot and cold water spouts using conventional threaded fasteners such as a male or female fastener at the end of each hose which leads into the showering cabinet to a single thermostatic control mixer valve. The thermostatic control mixer valve has a single water outlet pipe that connects to the shower spray conduits and nozzles, the perineal cleansing and shampoo conduits and nozzles, is manually set, works off mechanical principles (no electrical power needed), and provides for manual setting of a predetermined temperature of the water for all the systems. This is an important feature of the device from a portable standpoint since no permanent installation is required. Once inlet hot and cold water has been passed through the thermostat at the proper temperature, then each of the water supply conduit systems for the upper spray nozzles, the lower spray nozzles, the perineal/sitz bath, and the shampoo conduits are attached to the outlet of the thermostat control valve supply. The thermostat control valve also serves as a master valve for turning on and off all water entering, including the spray nozzles, the perineal cleansing, and the shampoo, which also may be individually placed in the on/off position by the control levers.

The inside seat is powered by a hydraulic cylinder that is also actuated by the supply water and a control valve on the seat, the cylinder being actuated by the water force entering that pushes the piston and the seat in a first direction with the water being diverted to the other side of the piston in the opposite direction for moving the seat inside the cabinet. This hydraulic cylinder and the companion operative control will allow the seat to be stopped in mid-range, during its projected 12 inch travel path. Positive stopping is obtained by the use of this type of hydraulic cylinder, and will remain in the stopped position for transfers in and out of the cabinet. The intended and specific function of the use of hydraulic type cylinder for seat movement forward and backward is to provide a safely movable chair for a disabled patient to transfer directly from a wheelchair onto the inside seat of the cabinet, via use of the side exterior mounted entry/exit horizontal panel. The movable interior seat allows easier patient access from the side or front of the cabinet for the patient when transferring into and out of the showering cabinet.

An important safety feature of the invention is a removable auxiliary horizontal seat panel that is mounted on the outside of the cabinet housing on one side and which is supported by a vertical rigid support member. The same side of the cabinet housing includes a vertical movable panel segment that can be manually moved out of the way to allow side entry or exit by a patient from the side of the cabinet with the patient being initially transferred while seated from the outside auxiliary seat panel and then moved sideways onto the interior bathing seat. This provides safety for the patient and allows the attendant caregiver the ability to safely move the patient and transfer the patient into and out of the bathing cabinet. Once the patient is on the hydraulically movable interior bathing seat safely inside the cabinet housing, the vertical side panel segment may be moved into position to prevent water from spraying out of the side of the cabinet.

The cabinet housing is supported above the floor surface by four casters, each of which can be locked in place which allows the entire cabinet to be moved from one location to another, easily and quickly. The bottom of the cabinet housing is a watertight bottom pan that includes a drainage system that can provide a draining hose and valve that can be opened to drain water by gravity into an existing floor drain, or with an auxiliary pump and additional hose to a higher located tub or sink drain.

One of the most important aspects of the invention is the fact that it is portable and that it does not require custom, elaborate, or permanent plumbing hardware for installation for providing the hot and cold water. The showering cabinet can be placed near accessible hot and cold water sources, such as sinks, diverter valve on showering heads, or tub spouts. The use of extended lengths of hose allows the incoming water to be obtained from a location separate from the intended place of use, such that the cabinet may be positioned for use in a bedroom, while appropriate lengths of hoses may be connected to the hot and cold water sources in the bathroom. In support of the desirability of the invention, the draining of the used showering water enhances the system's ability to be portable. In a setting where the draining hose may be placed in a flat horizontal position, such as laying on the floor of a shower stall, the system will drain via gravity draining. If a draining hose is placed up to and over a bathtub wall, elevated sink, or commode for draining, a small auxiliary pump is provided for the purpose of removing used showering water stored in the cabinet pan, then pumping this water by use of a second hose to the elevated drain source.

The use of an auxiliary pump and extra hose length serves the purpose of draining the cabinet of expended shower water at a remote location from the drain available, such as use of the cabinet in the bedroom with extended draining to the bathroom.

The cabinet body is preferably made as a dual shell, comprising an inner and outer molded walled structure constructed from fiberglass. Between the inner walled structure and the outer walled structure, there exists, that has an interior space within which the water supply conduits are mounted. On the exposed interior surface of the cabinet housing there are a plurality of spray nozzle openings that are connected to one or more conduits that constitute the water supply for specific spray areas inside the showering cabinet. For example, there are a plurality of upper spray nozzles disposed along the exposed interior upper portion of the interior cabinet housing which uses a separate controlled water supply conduit system from the lower spray nozzles which have their own controlled conduit water supply system. Water is also supplied in a separate conduit to the flexible hose and hand-held shampoo nozzle mounted on the exterior of the housing, allowing the caregiver to shampoo by hand a patient sitting inside the cabinet. A fourth water supply conduit is used for the perineal/sitz bath and supplies water to a spray pipe mounted under the seat where the patient sits, adjacent a slot in the seat body.

Hot and cold water is supplied by individual hot and cold water faucets conventionally mounted at a sink, tub, or shower. Mounted to the cabinet, preferably on the back side between the shelves, is a mechanically-actuated water thermostat control valve that has two water supply inlets, one hot and one cold, where hot and cold water are mixed at the valve site with a single water output which is the supply water for the showering cabinet at the desired temperature. Connected to each hot and cold inlet conduit in the cabinet that terminate at the thermostatic control valve are individual flexible hoses having conventional female/male threaded fasteners at each end which are coupled directly to each sink faucet, hot and cold. The outlet supply conduit or pipe within the housing that comes from the thermostatic control valve thus leads to the individual shower conduits terminating in nozzles, the shampoo supply conduit, and the perineal bath water supply conduit that terminates in a spray. The supply system, including the thermostatic control valve, does not require any electrical power since the valve is mechanical and is set mechanically as to the desired temperature.

Hydraulic power from the water supply is also provided by a separate conduit to a hydraulic cylinder that can move the seat forward and backward along a track to assist in patient egress or exit of the shower by allowing the seat to be moved forward near the front door for easy access by ambulatory users, and for direct wheelchair transfer by the side door for the non-ambulatory. The front door housing of the cabinet which extends almost to floor level opens, permitting a wide access area without a step up to assist the patient being placed onto the seat. The patient or the caregiver has easy access to a manually controlled seat mover that can be pushed forward or backward forcing the seat to move in a desired direction. The seat is mounted in a track that is connected to the side walls of the housing for support, allowing the seat to move forward and backward along the track.

The inside bottom floor of the cabinet includes a waterproof pan with a drain and strainer cover. The pan-type bottom is tapered downwardly to a center drain hole to allow the water to be collected by gravity, traveling from the drain into the drain hose mounted under the bottom pan extending to the outside back of the cabinet. The used water can then be emptied directly into a floor drain or other flat, vertical draining source, such as a shower stall. If there is no floor drain but there is access to a higher drain, the drain hose may be connected to an auxiliary pump having a second drain hose which is connected to the higher drain (sink or tub). The force of the pump allows the used water to be pumped upward to a higher level, allowing draining to be into a sink, tub, or commode. The drain system again accents the portability of the unit and the fact that it does not need permanent plumbing installation.

By using the present invention, hygienic care can be achieved quickly and safely for a patient wherein the entire shower system requires no installation.

It is an object of this invention to provide an improved, portable showering cabinet that requires no special plumbing installation and that can be used in private homes, hotels, residential schools, general and specialized hospitals, rehabilitation centers, adult day care centers, and nursing homes for daily hygienic care for non ambulatory and ambulatory patients safely and economically.

Another object of this invention is to provide an improved, portable showering cabinet that requires no special plumbing installation and that can be moved anywhere within an institution or home, adjacent conventional water faucets to provide hot and cold water for providing showers for non ambulatory patients safely and conveniently.

And yet another object of this invention is to provide an economical and safe showering cabinet that allows the wheelchair user access safely and conveniently to the showering cabinet while the showering cabinet itself is portable with an auxiliary side access seat and movable cabinet side panel.

A further object of the present invention is to provide a showering cabinet that permits user access safely and conveniently to the showering cabinet including an auxiliary side access seat and door having a wrap around member which encloses the cabinet when the door is closed.

In accordance with these and other objects which will become apparent hereinafter, the instant invention will now be described with particular reference to the accompanying drawings.

DETAILED DESCRIPTION OF THE INVENTION

Figure 1:
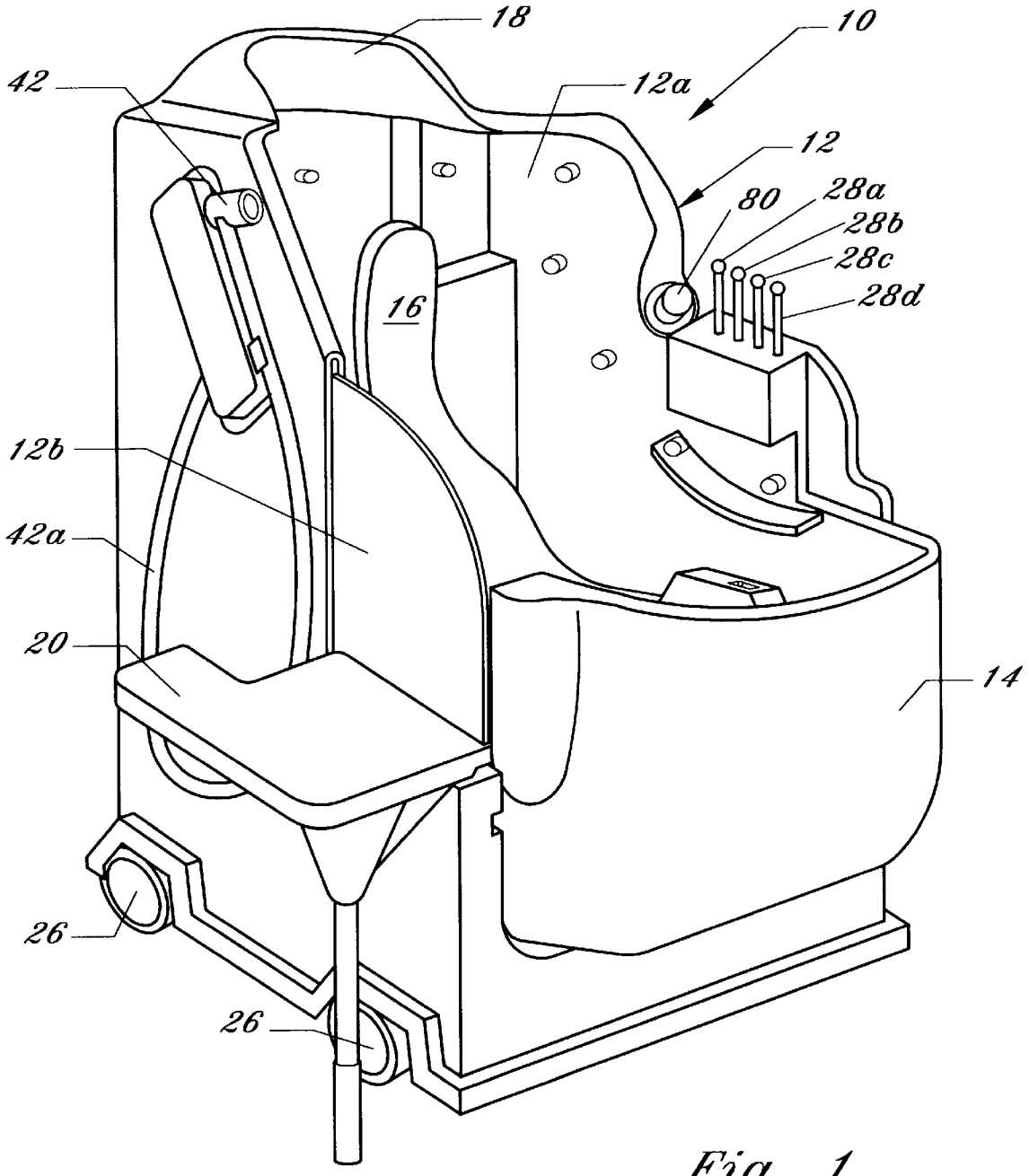
FIG. 1 shows a perspective view of the invention with the front door closed.

Referring now to the drawings and in particular FIG. 1, the present invention is shown generally at 10, comprised of a waterproof housing 12 that is substantially rectangularly shaped and preferably made of fiberglass, having an open top and front portion that can be enclosed with a movable door 14 that pivots and is hinged on one side and which also prevents water from being splashed out of the interior 12*a* of housing 12 in the closed position. The housing 12 is attached to four casters 26 which connect to the bottom of the housing to allow ease of movement of the bathing cabinet. The bath housing 12 includes a unitarily formed bottom interior floor that has a pan that collects waste water, described in greater detail below. The four casters 26 may include individual locks 27 for stabilizing the housing in place at a desired location.

The bathing cabinet housing 12 also includes a head shield 18 that prevents water backsplash while shampooing a patient seated inside the cabinet on seat 16.

The shampoo nozzle spray device 42 is a manually controlled, movable shower spray nozzle connected to a flexible water hose 42*a* that attaches to the main water supply described below. The shower head 42 is stored on the outside panel of the housing as shown in FIG. 1 when not in use.

Mounted below the hand held shower nozzle 42 on the outside of the cabinet is a detachable, horizontal rigid auxiliary seat 20 to provide safe entry or exit by a patient with the help of a caregiver. A patient can be transferred from a wheelchair to the auxiliary seat 20 and then moved sideways onto the main bathing seat 16. The bathing cabinet includes a vertical, slidable panel 12*b* adjacent the auxiliary seat 20 for enclosure once the patient is safely inside the cabinet housing to prevent water from being sprayed from within the cabinet housing 12 to the outside floor.

A hydraulically movable inside seat 16 is included that allows the seat 16 to be moved forward and backwards for egress and ingress of the patient through the front or side of the cabinet when the front door 14 is in open position. (FIG. 2) The seat 16 also includes an attached one or more spray nozzles 19 spraying through an aperture in the seat for providing a sitz bath and perineal cleansing that is controlled hydraulically on and off with valve 28*d*.

The housing 12 includes four closely aligned water control valves 28(*a–d*) for operating one upper and one lower shower nozzle, one shampoo nozzle and one perineal sitz bath, respectively. The valves 28(*a–d*) are suitably mounted for easy access by a seated user or by a caregiver for individual control of each spray.

The cabinet housing 12 is constructed of two separate waterproof shells, preferably made of premolded fiberglass, joined together along a bonded seam. The water supply pipes are mounted inside between the inner and outer housing panels.

Figure 2:
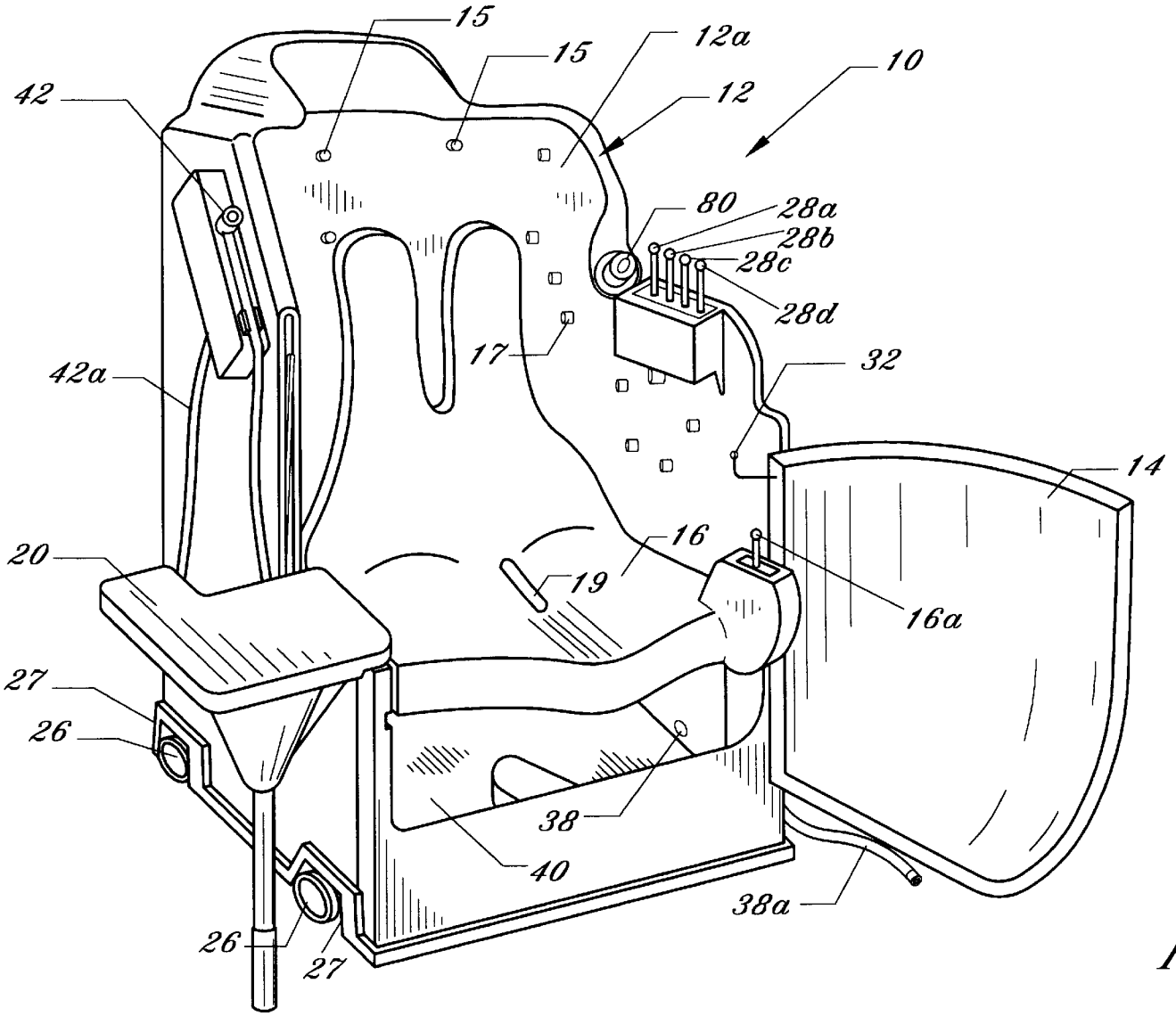
FIG. 2 shows a perspective view of the bathing cabinet representing the present invention with the cabinet door in an open position.

FIG. 2 shows the cabinet housing 12 with the front door 14 open. The patient's seat 16 has been moved to its forward position near the front of the housing 12. An actuating handle 32 is used to close the door 14 securely. Note that the housing 12 includes a slanted internal floor drain pan 40 below the front panel of the housing that allows for the collection of used bathing water and a drain 38 and drain hose 38*a* to allow water that collects in the bottom pan 40 expended from the shower and shampoo to be transferred by gravity to an existing permanent floor drain at the care facility. An independent separate auxiliary pump and extra hose (hand or electrical) could be attached to the end of hose 38*a* to pump waste water out of pan 40 to a higher existing sink drain, or tub drain or commode.

The seat 16 is controlled in forward/rearward movement by a hydraulically actuated piston controlled by actuating lever 16*a* that moves the seat 16 forward and backward under water pressure. The most forward position of the seat 16 occurs (with door 14 open) to receive the patient from the front or side entrance so that transfer into the cabinet is easier because of the forward location of the seat 16. Once the patient is established comfortably on the seat 16, the seat 16 is hydraulically moved rearward, positioning the patient within the cabinet. The door 14 is then closed.

Figure 3:
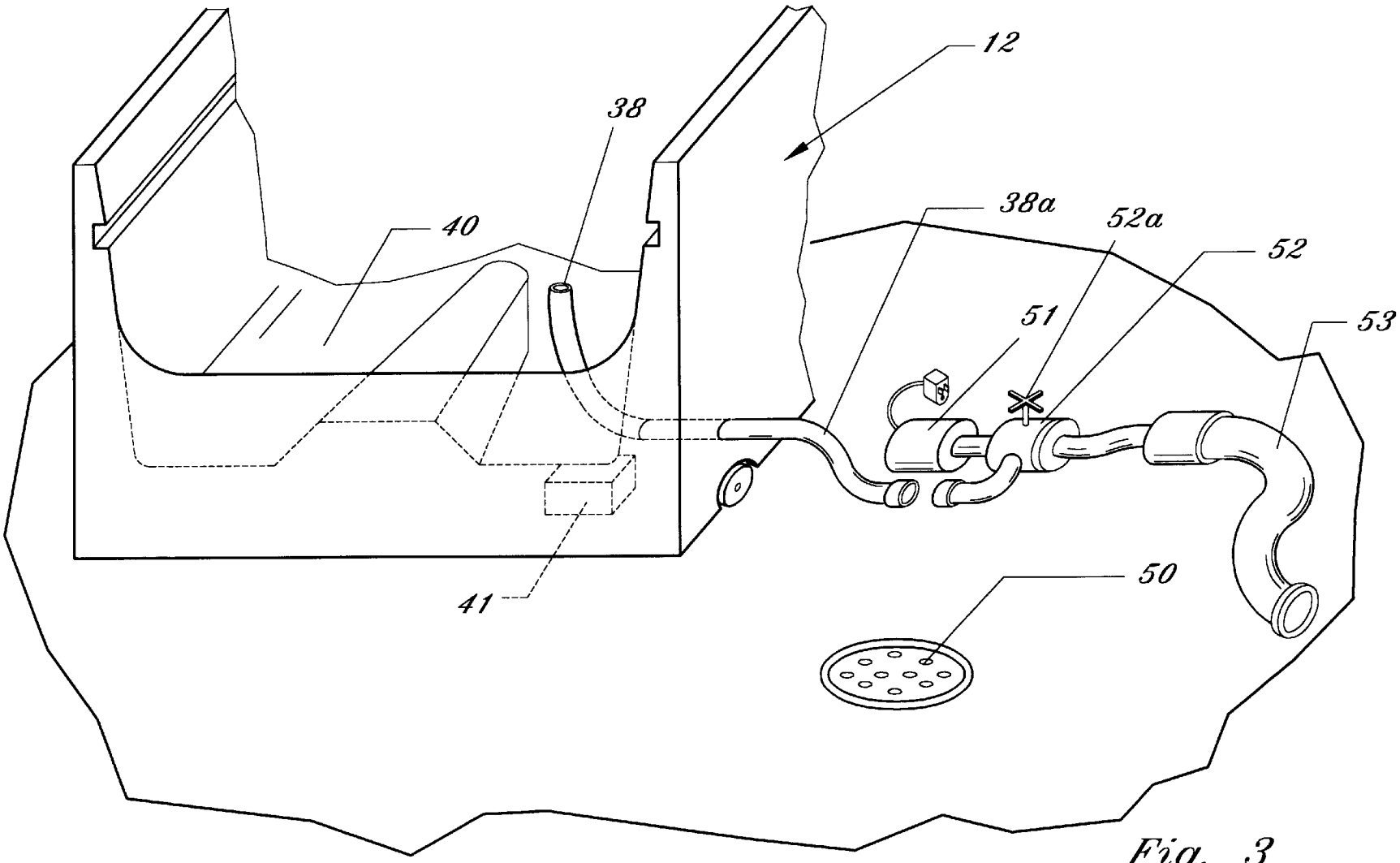
FIG. 3 shows a perspective view of the water collector pan in the bottom of the housing partially cut away.

Referring now to FIG. 3, the bottom internal floor of housing 12 is shown in a cut away view that shows a special shaped surface of pan 40 that allows water used in the bathing process to be received in the bottom housing 12 and by gravity drain towards a drain opening 38 on the bottom of the pan that is likewise connected to a drain hose 38*a* which can go to an existing facility floor drain 50 to which the end of hose 38*a* can be positioned for draining the water. If an existing facility drain is in a sink, commode or shower that requires the end of hose 38*a* to be raised significantly above the floor, then an auxiliary pump 52 could be used to pump the water to a higher level for drainage to an existing facility drain, through hose 53. The pump 52 and motor 51 could be plugged into an existing outlet for electrical power or could be manually actuated as a hand pump 52*a*. In an alternate embodiment, the bottom floor of the housing 12 could also have a collecting tank 41 for collecting waste shower water during the showering operations which can be disposed of at a later time at a different location in the facility if drains were not available in the immediate area where the showering takes place.

The shower cabinet is portable and may be manually moved on its casters to bedside locations or other location within a private home or institution near water faucets and conventional drains. The cabinet is constructed to provide for safe transfer of the patient into and out of the seat, either through the front door access or through a side auxiliary seat. The shower water spray may be operated by the patient or by caregiver standing next to the cabinet.

Figure 4:
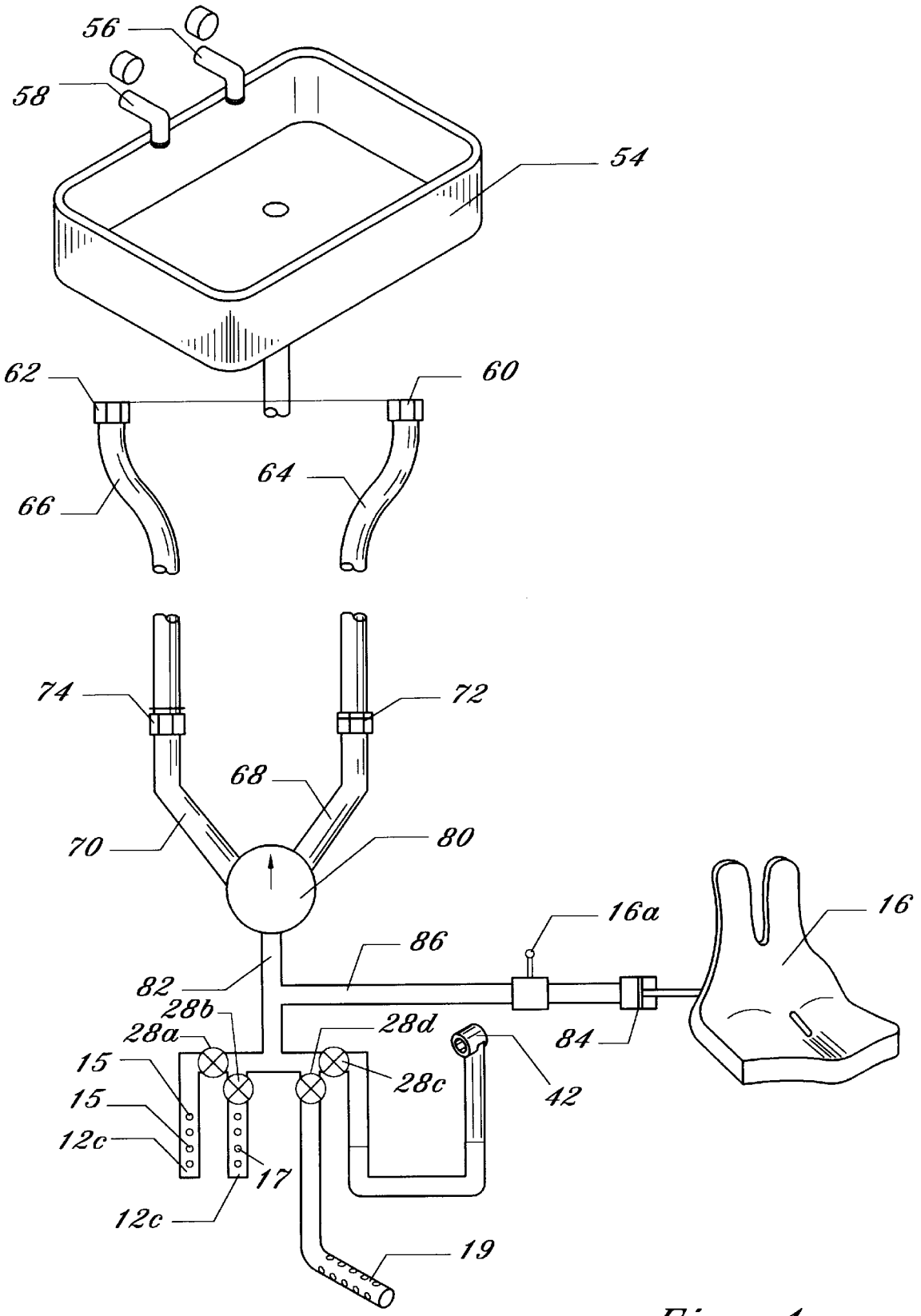
FIG. 4 shows a front schematic diagram of the plumbing system (hot and cold water inlet) and bathing nozzles used with the invention.

FIG. 4 shows the water supply pipe array (schematically) used throughout the housing 12 for the shower cabinet. At a given care facility or private home, a standard sink 54 will include cold and hot water faucets 56 and 58.

The shower cabinet plumbing system includes flexible water supply hoses 64 and 66 which can be manually extended outside the cabinet and have conventional threaded fasteners such as a female threaded fasteners 60 and 62 which attach to cold and hot water faucets 56 and 58 in a conventional way. The hoses 64 and 66 are attached to threaded fasteners 72 and 74 which connect to internal cabinet pipes 68 and 70 representing hot and cold water pipes that are joined at a mechanical thermostatic temperature control valve 80 that allows the user to set a predetermined temperature for combining hot and cold water from inlet supplier pipes 68 and 70 at the valve 80. A single water supply pipe 82 then is the output of valve 80 which leads to the spray nozzles 15 and 17 used for bathing in the cabinet on separate pipes 12*c* controlled individually as upper and lower nozzles through control valves 28*a* and 28*b*. The sitz bath spray 19 which is attached under the slot in seat 16 and the supply pipe have a shut off/on valve 28*d*. The shampoo nozzle 42 also has an on/off control valve 28*c*. Water under pressure from pipe 82 can be used to power a piston 84 that moves seat 16 backward and forward by the piston control 16*a* which supplies water through the appropriate side of the piston from conduit 86.

Figure 5:
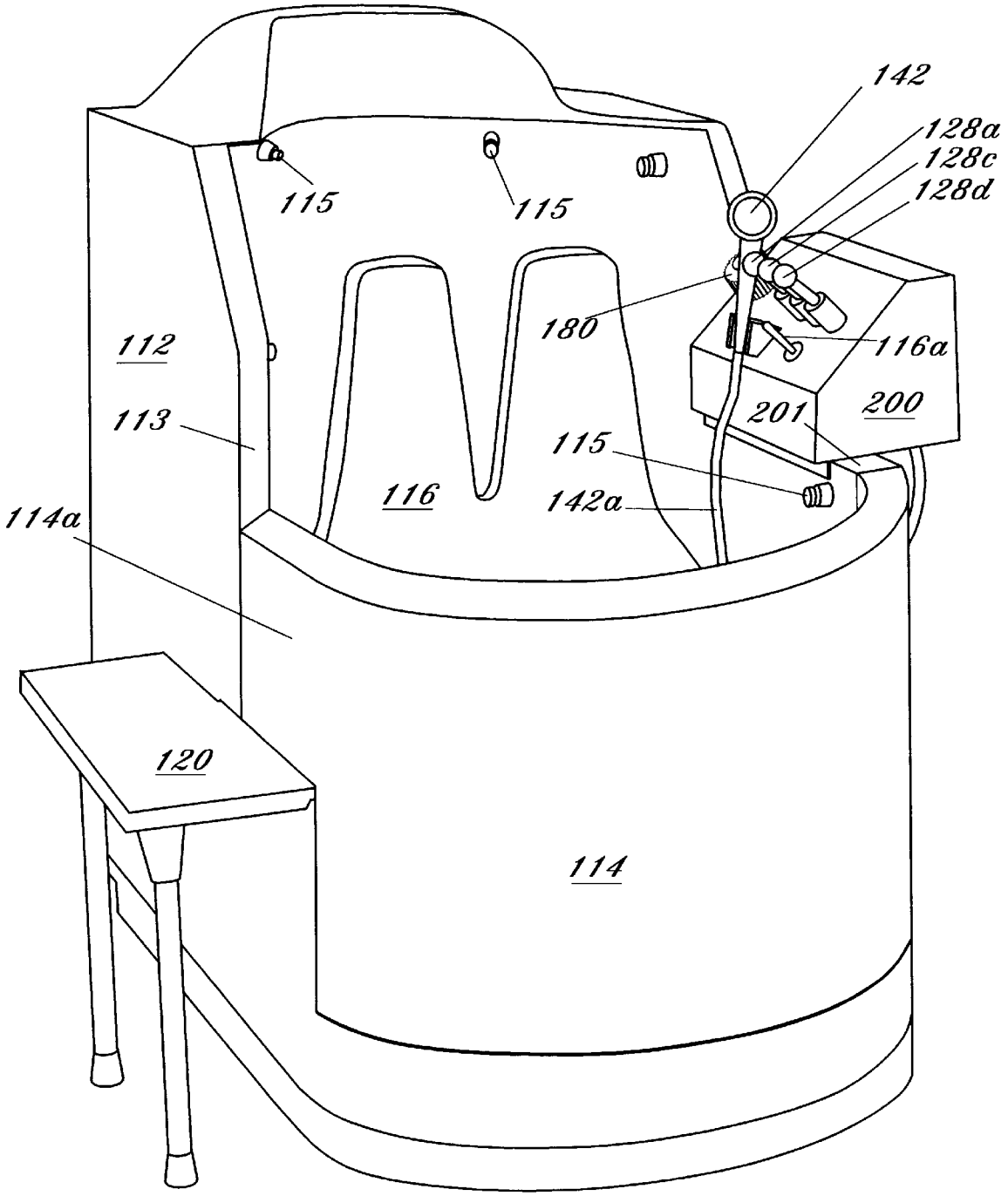
FIG. 5 illustrates a perspective view of an alternate embodiment of the present invention with the door closed.
Figure 6:
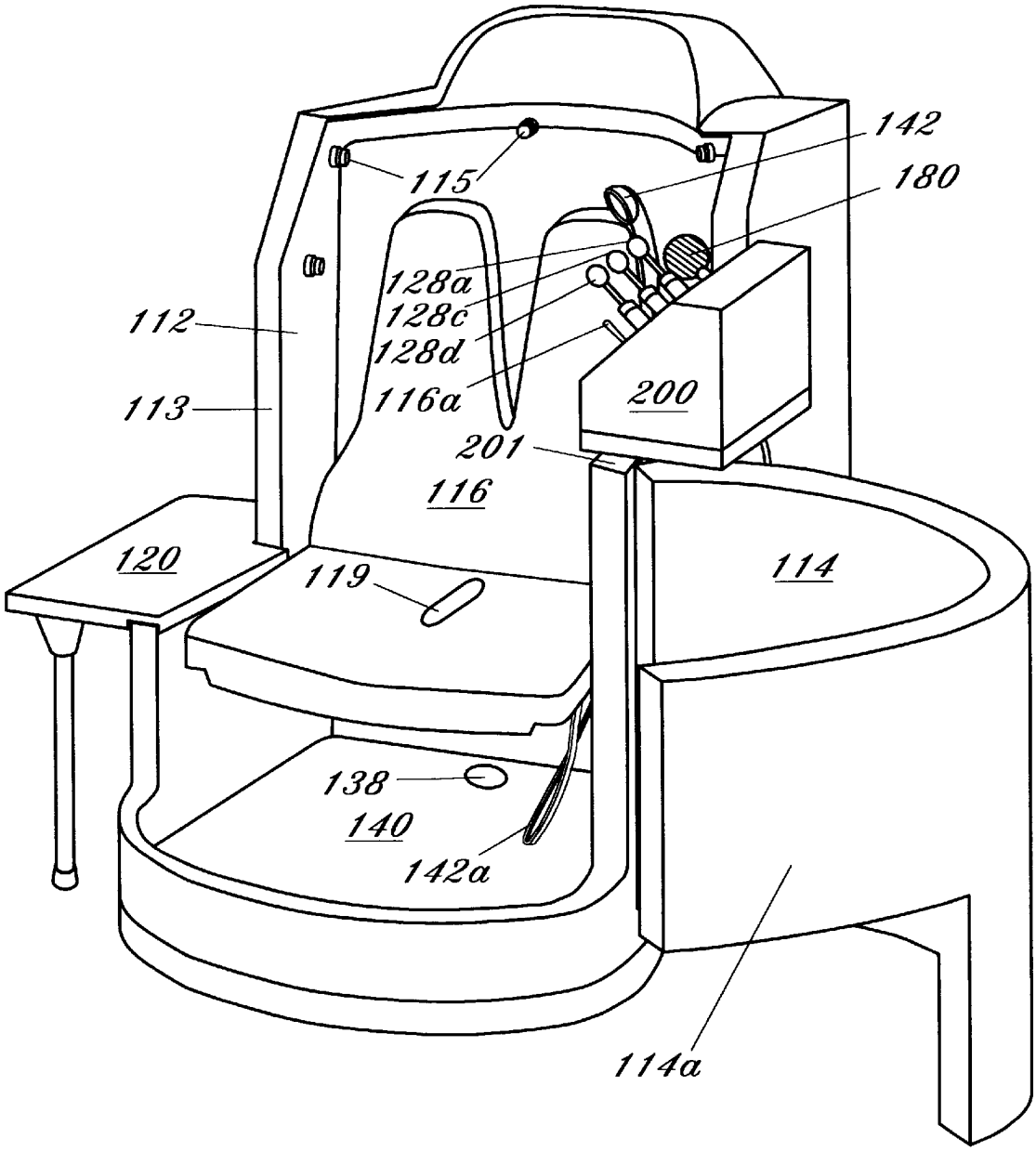
FIG. 6 illustrates a perspective view of an alternate embodiment of the present invention with the door open.

An alternate embodiment of the present invention is illustrated in FIGS. 5 and 6 which utilizes the same water disposal scheme as shown in FIG. 3, and described hereinabove, and the same control scheme as shown in FIG. 4 and described hereinabove. To avoid redundancy in description, features functionally identical to features described hereinabove are shown in FIGS. 4 and 5 having the same reference numerals with "100" added thereto. For example, door 14 in the embodiment shown in FIGS. 1 and 2, is door 114 in the embodiment shown in FIGS. 5, and 6.

Referring to FIGS. 5 and 6, door 114 includes a wrap around member 114*a*. Wrap around member 114*a* replaces vertical slidable panel 12*b* of the embodiment shown in FIG. 1. Wrap around member 114*a* simplifies construction of housing 112 by eliminating the need for vertical, slidable panel. When door 114 is closed as shown in FIG. 5, wrap around member 114*a* provides a secure fit against edge 113 to prevent water from escaping from the interior of housing 112. Easy access for a user of the invention is still provided when door 114 is open, as shown in FIG. 6, and wrap around member 114*a* is out of the way of the front area of housing 112.

A plurality of individually adjustable spray jets 115, shampoo nozzle 142, and perineal cleansing nozzle 119 are controlled by valves 128*a*, 128*c*, and 128*d*, respectively. Valve controls 128*a*, 128*c*, and 128*d* are suitably positioned on control panel 200. Thermostatic temperature control valve 180 and piston control 116*a*, for for/aft movement of seat 116, are also located on control panel 200.

Control panel 200 is removable from edge surface 201 for ease in transporting housing 112. For convenience, water entering the present invention, as shown in FIG. 4, can first go directly to control panel 200.

Horizontal support surface 120 is also removable from housing 112 to ease in transport of the invention.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A showering cabinet for offering hygienic care, including body showering, for an ambulatory or non-ambulatory patient, comprising:

a housing sized to receive a seated patient that includes at least one substantially vertical side wall forming an enclosure and a bottom floor attached to said side wall to form a water resistant enclosure for enclosing a patient;

said at least one substantially vertical side wall including a substantially vertical slidable panel segment having a first position providing an opening in said side wall to allow a patient ingress and egress into and out of said enclosure in the first position and a closed, second position to act as a water spray barrier;

a substantially rigid movable closure connected to said housing, having a first position for patient ingress and egress into and out of said housing enclosure and a second, closed position which provides a water spray barrier;

a rigid, substantially planar, horizontally disposed, detachable seat panel mounted to the outside of said housing adjacent said slidable panel segment, and at least partially disposed outside of said housing at a predetermined position for receiving a seated patient temporarily adjacent said housing for transfer into and out of said housing;

a vertical rigid member supporting said detachable seat panel;

means for spraying water within said enclosure connected to said housing;

a patient seat disposed within said housing enclosure and connected to said housing for receiving a patient; and means for manually moving said housing along a floor surface, said means connected to said housing for providing portability of the showering cabinet wherein said showering cabinet may be moved to a desired location.

2. A showering cabinet as in claim 1, wherein:

said means for moving said housing along said floor surface includes a plurality of wheels.

3. A showering cabinet as in claim 2, wherein:

said means for moving includes means for locking at least one of said plurality of wheels to prevent movement of said showering cabinet.

4. A showering cabinet as in claim 1, wherein:

said means for spraying water within said enclosure includes a plurality of spray nozzles attached to said enclosure, and at least one control valve.

5. A showering cabinet as in claim 4, including:

a flexible hose connectable at one end to said means for spraying water and at the other end to a conventional water faucet.

6. A showering cabinet as in claim 5, wherein:

said flexible hose includes means for simultaneous connection to a conventional cold water faucet and a conventional hot water faucet.

7. A showering cabinet as in claim 6, including:

a water temperature thermostatic control valve connected to said means for spraying water to allow the water temperature to be adjusted to a preselected temperature for spraying.

8. A showering cabinet as in claim 4, wherein said plurality of spray nozzles are aligned to produce a cross spray effect resulting in maximum water coverage for the patient.

9. A showering cabinet as in claim 1, including:

means for draining expended showering water mounted on the bottom floor of said cabinet to a drain outside of said cabinet.

10. A showering cabinet as in claim 9, including:

an auxiliary pump connectable to said means for draining expended shower water, said auxiliary pump including a flexible conduit connected to said auxiliary pump which permits draining expended showering water in the bottom floor of said cabinet to a drain mounted higher than said bottom floor of said cabinet.

11. A showering cabinet as in claim 10, including:

a collecting tank for collecting expended shower water mounted in the bottom of the housing enclosure for collecting used showering water temporarily, which can be drained later.

12. A showering cabinet as in claim 1, wherein:

said patient seat is movable between a first position adjacent the rear of said housing and a second position forward in said housing to allow a patient ingress and egress into and out of said enclosure; and means to hydraulically move said patient seat between said first and said second positions.

13. A showering cabinet as in claim 1, further including a hand-held spray nozzle mounted to the exterior of said housing and connected to a flexible hose.

14. A showering cabinet for offering hygienic care, including body showering, for an ambulatory or non-ambulatory patient, comprising:

a housing sized to receive a seated patient that includes at least one substantially vertical side wall forming an enclosure and a bottom floor attached to said side wall to form a water resistant enclosure for enclosing a patient;

said at least one substantially vertical side wall including an opening to allow a patient ingress and egress into and out of said enclosure;

a substantially rigid movable closure connected to said housing, having a first position for patient ingress and egress into and out of said housing enclosure and a second, closed position which provides a water spray barrier, said closure including an extended member disposed within said opening in said substantially vertical wall when said movable closure is in said second position to provide a water spray barrier;

a rigid, substantially planar, horizontally disposed, detachable seat panel mounted to the outside of said housing adjacent said extended member, and at least partially disposed outside of said housing at a predetermined position for receiving a seated patient temporarily adjacent said housing for transfer into and out of said housing;

a vertical rigid member supporting said detachable seat panel;

a plurality of individually adjustable water spray nozzles disposed in preselected locations on the interior of said housing; and a patient seat disposed within said housing enclosure and connected to said housing for receiving a patient.

15. The device of claim 14 further including a removable control panel for controlling water spray through said plurality of water spray nozzles.

16. The device of claim 15 further including a thermostatically adjustable temperature control for controlling the temperature of said water spray.

17. The device of claim 15 further including a hand-held spray nozzle mounted to the exterior of said housing and connected to a flexible hose member, and a control for said spray nozzle disposed on said removable control panel.

18. The device of claim 15 wherein said patient seat is movable between a first position adjacent the rear of said housing and a second position forward in said housing to allow a patient ingress and egress into and out of said enclosure; and means to hydraulically move said patient seat between said first and said second positions.

19. A showering cabinet for offering hygienic care, including body showering, for an ambulatory or non-ambulatory patient, comprising:

a housing sized to receive a seated patient that includes at least one substantially vertical side wall forming an enclosure and a bottom floor attached to said side wall to form a water resistant enclosure for enclosing a patient;

said at least one substantially vertical side wall including an opening to allow a patient ingress and egress into and out of said enclosure;

a substantially rigid movable closure connected to said housing, having a first position for patient ingress and egress into and out of said housing enclosure and a second, closed position which provides a water spray barrier, said closure including an extended member disposed within said opening in said substantially vertical wall when said movable closure is in said second position to provide a water spray barrier;

a rigid, substantially planar, horizontally disposed, detachable seat panel mounted to the outside of said housing adjacent said extended member, and at least partially disposed outside of said housing at a predetermined position for receiving a seated patient temporarily adjacent said housing for transfer into and out of said housing;

a vertical rigid member supporting said detachable seat panel;

a plurality of individually adjustable water spray nozzles disposed in preselected locations on the interior of said housing;

a patient seat disposed within said housing enclosure and connected to said housing for receiving a patient, said patient seat being movable between a first position adjacent the rear of said housing and a second position forward in said housing to allow a patient ingress and egress into and out of said enclosure, including means to hydraulically move said patient seat between said first and said second positions;

a thermostatically adjustable temperature control for controlling the temperature of water spray from said plurality of water spray nozzles; and a removable control panel for controlling water spray through said plurality of water spray nozzles, for controlling said means to hydraulically move said patient seat, and for mounting said thermostatically adjustable temperature control.

20. A showering cabinet for offering hygienic care, including body showering, for an ambulatory or non-ambulatory patient, comprising:

a housing sized to receive a seated patient that includes at least one substantially vertical side wall forming an enclosure and a bottom floor attached to said side wall to form a water resistant enclosure for enclosing a patient;

said at least one substantially vertical side wall including a substantially vertical slidable panel segment having a first position providing an opening in said side wall to allow a patient ingress and egress into and out of said enclosure in the first position and a closed, second position to act as a water spray barrier;

a substantially rigid movable closure connected to said housing, having a first position for patient ingress and egress into and out of said housing enclosure and a second, closed position which provides a water spray barrier;

a rigid, substantially planar, horizontally disposed, detachable seat panel mounted to the outside of said housing adjacent said slidable panel segment, and at least partially disposed outside of said housing at a predetermined position for receiving a seated patient temporarily adjacent said housing for transfer into and out of said housing;

a vertical rigid member supporting said detachable seat panel;

means for spraying water within said enclosure connected to said housing wherein said means for spraying water includes a plurality of spray nozzles attached to said enclosure, and at least one control valve;

said plurality of spray nozzles are aligned to produce a cross spray effect resulting in maximum water coverage for the patient;

a patient seat disposed within said housing enclosure and connected to said housing for receiving a patient wherein said patient seat is movable, via hydraulic means, between a first position adjacent the rear of said housing and a second position forward in said housing to allow a patient ingress and egress into and out of said enclosure;

a plurality of wheels for manually moving said housing along a floor surface, said plurality of wheels connected to said housing for providing portability of the showering cabinet wherein said showering cabinet may be moved to a desired location and wherein said plurality of wheels include means for locking at least one of said plurality of wheels to prevent movement of said showering cabinet;

a flexible hose connectable at one end to said means for spraying water and at the other end to a conventional water faucet wherein said flexible hose includes means for simultaneous connection to a conventional cold water faucet and a conventional hot water faucet;

a water temperature thermostatic control valve connected to said means for spraying water to allow the water temperature to be adjusted to a preselected temperature for spraying;

means for draining expended showering water mounted on the bottom floor of said cabinet to a drain outside of said cabinet;

an auxiliary pump connectable to said means for draining expended shower water, said auxiliary pump including a flexible conduit connected to said auxiliary pump which permits draining expended showering water in the bottom floor of said cabinet to a drain mounted higher than said bottom floor of said cabinet;

a collecting tank for collecting expended shower water mounted in the bottom of the housing enclosure for collecting used showering water temporarily, which can be drained later; and a handheld spray nozzle mounted to the exterior of said housing and connected to a flexible hose.

21. A showering cabinet for offering hygienic care, including body showering, for an ambulatory or non-ambulatory patient, comprising:

a housing sized to receive a seated patient that includes at least one substantially vertical side wall forming an enclosure and a bottom floor attached to said side wall to form a water resistant enclosure for enclosing a patient;

said at least one substantially vertical side wall including an opening to allow a patient ingress and egress into and out of said enclosure;

a substantially rigid movable closure connected to said housing, having a first position for patient ingress and egress into and out of said housing enclosure and a second, closed position which provides a water spray barrier, said closure including an extended member disposed within said opening in said substantially vertical wall when said movable closure is in said second position to provide a water spray barrier;

a rigid, substantially planar, horizontally disposed, detachable seat panel mounted to the outside of said housing adjacent said extended member, and at least partially disposed outside of said housing at a predetermined position for receiving a seated patient temporarily adjacent said housing for transfer into and out of said housing;

a vertical rigid member supporting said detachable seat panel;

a plurality of individually adjustable water spray nozzles disposed in preselected locations on the interior of said housing;

a patient seat disposed within said housing enclosure and connected to said housing for receiving a patient wherein said patient seat is movable, via hydraulic means, between a first position adjacent the rear of said housing and a second position forward in said housing to allow a patient ingress and egress into and out of said enclosure;

a removable control panel for controlling water spray through said plurality of water spray nozzles;

a thermostatically adjustable temperature control for controlling the temperature of said water spray; and a handheld spray nozzle mounted to the exterior of said housing and connected to a flexible hose member, and a control for said spray nozzle disposed on said removable control panel.

* * * * *